United States Patent [19]

Deutsch

[11] 4,018,440

[45] Apr. 19, 1977

[54] INVALID WALKER WITH WHEEL CONTROL MECHANISM

[76] Inventor: Fritz A. Deutsch, 25801 Lake Shore, Apt. 87, Euclid, Ohio 44132

[22] Filed: Mar. 31, 1975

[21] Appl. No.: 563,615

[52] U.S. Cl. ..... 272/70.3; 188/31; 188/167

[51] Int. Cl.[2] ..... A61G 13/00

[58] Field of Search ..... 272/70.3; 135/49; 188/31, 60, 69, 167, 110, 176

[56] References Cited

UNITED STATES PATENTS

| | | | |
|---|---|---|---|
| 3,090,470 | 5/1963 | Abrams | 188/69 X |
| 3,130,814 | 4/1964 | Aquila | 272/70.3 |
| 3,279,567 | 10/1966 | Kempel | 272/70.3 X |
| 3,356,185 | 12/1967 | Isaacks | 188/69 X |

*Primary Examiner*—Richard C. Pinkham
*Assistant Examiner*—T. Brown
*Attorney, Agent, or Firm*—Ray S. Pyle

[57] ABSTRACT

A walker to aid an invalid is disclosed. The walker includes a frame mounted on at least one wheel to allow the walker to roll along the floor. The frame and at least one wheel have coacting lock-catch-and-release means arranged such that when the user pushes down on the frame the lock will release and allow the walker to roll a measured, predetermined distance and thereat lock. Further movement is prevented until the frame is released and pressure again applied.

3 Claims, 17 Drawing Figures

INVALID WALKER WITH WHEEL CONTROL MECHANISM

BACKGROUND OF THE INVENTION

The present invention concerns an invalid walker with controlling rolling motion.

A walker of prior art configuration is a lightweight frame on which the handicapped person afflicted with walking difficulty can lean to support the weight of his body. The usual way to use the walker is for the handicapped person to lift the walker, carry the device while he is taking steps and periodically set it down and support his weight on it. With this procedure a handicapped person finds relief only during the intervals in which he is not moving. The moment he executes steps in any chosen direction he must forgo the walker's support, and this under worsened condition, because during the walk he must be burdened not only by his own weight, bu also with that of the walker (though lightweight) which he must carry.

There have been attempts to improve walker performance by fitting it with wheels and at the same time controlling the walker's rolling motion with some form of braking applied by the user. Because the braking action requires a positive action on the part of the user himself, a high degree of insecurity is introduced which may endanger the handicapped, especially in the case of one whose sense of balance is impaired.

SUMMARY OF THE INVENTION

The recited limitations of present walker designs are overcome by providing the handicapped with all-time rolling support without lifting his weight from the walker, and, further by providing a positive stop action not requiring operator initiation by allowing him to trigger at will the increment-by-increment advancement of the walker. He will thereby move from each stopped position over a predetermined distance which is inherently controlled, rather than operator controlled. In this way, faster, less strenuous and safer walker aided travel is provided.

Accordingly, the principal object of the present invention is to provide a rolling walker with at least one wheel, whose advancement in any direction is limited to a controlled predetermined distance or increment by a programmed mechanical controller which is initiated by the user.

Another object of the invention is the provision for initiating the incremental motion release by pressing down the front section of the frame of the walker against a given spring tension.

A further object of the invention concerns means to regulate the motion release arrangement in harmony with the user's weight, walking ability and the degree of the invention to provide means which allows preselection of the predetermined distance of the walker's advancement when initiated by the user each time he engages the front section of the walker frame.

A further object of the invention is to provide capability to set up the walker for unlimited rather than limited motion release, i.e. the walker in this instance can be advanced in any direction without limitation as long as the handicapped person so determines. This provision is aligned to persons who are less seriously afflicted with walking difficulty.

For the least handicapped person the invention provides means to completely disengage the motion control. In this case, a freely rolling walker is offered.

Finally, it is an object of the invention to provide adjustable braking components which allow regulating the ease with which the walker, when released, can be advanced by the handicapped person.

The invention is described in the preferred embodiment of two pivotable wheels attached to the rear of the walker frame and one fixed wheel in center front. All members related to the incremental motion control, according to the invention, are coordinated with the wheel in the front section of the walker.

DESCRIPTION OF THE PREFERRED EMBODIMENT

Figure 1:
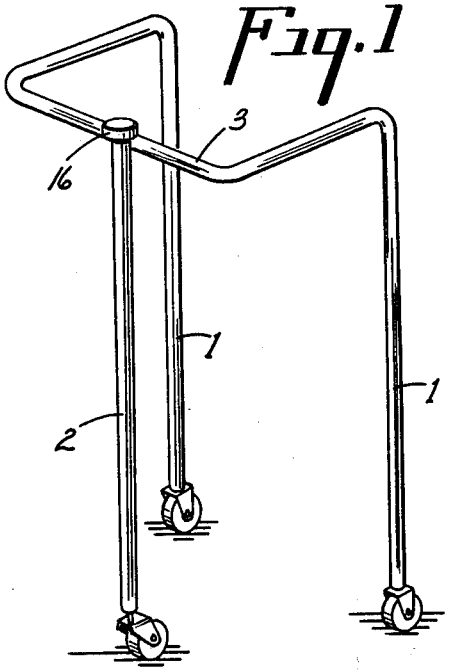
FIG. 1 is a perspective view of a three leg embodiment of a walker with wheels.

An embodiment of a walker with three frame legs, which may be controlled in accordance with this invention, is shown in perspective view in FIG. 1. The frame of the walker is formed by rigidly connecting the upper ends of two rear upright tubings 1 and a single center front upright tubing 2 by means of a horizontal U-shaped railing frame 3. To the lower end of each tubing 1 roller means in the form of a caster wheel is attached. The single tubing 2 in front center carries at its lower end roller means in the form of a wheel.

Figure 2:
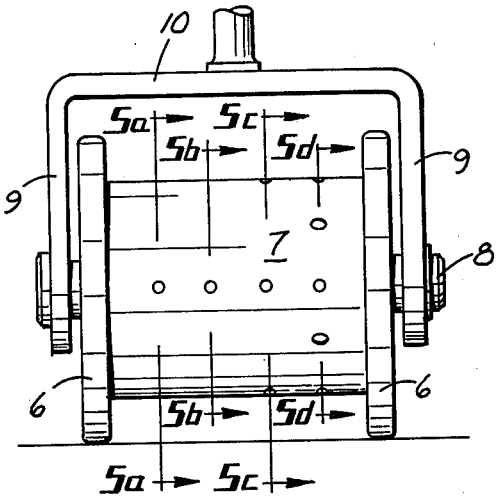
FIG. 2 is a detailed front elevational view of a control wheel for the walker, according to the invention.

Referring now to FIG. 2, the improvement of this invention provides a control wheel formed by a pair of rims 6 which are rigidly and concentrically connected to a drum 7 arranged betwen the rims 6. The assembly of rims 6 and drum 7 is rotatably supported on a shaft 8, which in turn is supported on a U-shaped frame having side arms 9 and a horizontal connector 10.

Figure 3:
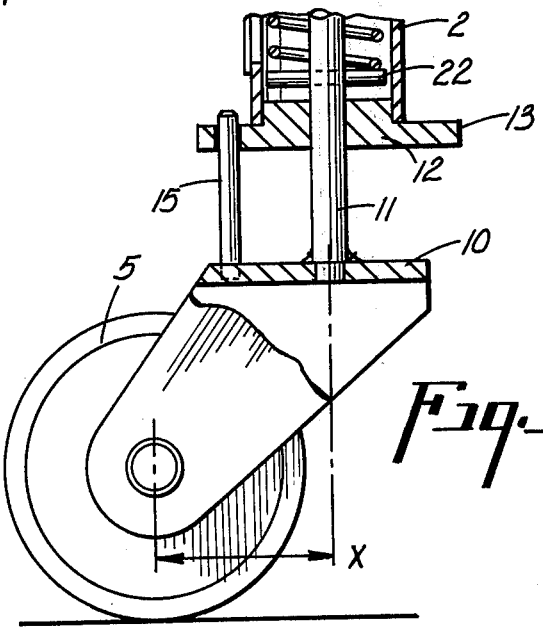
FIG. 3 is a longitudinal sectional view of the mounting of a control wheel in the front leg of the walker, with the lock and release mechanism of FIG. 2 omitted.

Referring now to FIG. 3, a vertical shaft 11 is rigidly connected to connector 10. Vertical shaft 11 is arranged within tubing 2 of the center front section of the frame. Shaft 11 is centered within tubing 2 by a lower bearing 12 and upper bearing portion of a knob 16. The lower bearing 12 is formed by a cylindrical cap flange 13 which is inserted in the lower end of tubing 2. Between flange 13 and horizontal extension 10 a clearance is provided to allow tube 2 and the assembly it contains to slide down on shaft 11. A pin 15 fixed to extension 10 and slidable in flange 13 holds the control wheel 5 against pivoting.

A hollow threaded bar or screw 14 extending from knob 16 serves as an upper bearing for shaft 11. Screw 14 is non-rotatively secured to adjusting knob 16. Knob 16 rests on the upper rim of tubing 2 and can turn within tubing 2. However, it is prevented from leaving tubing 2 by a pin 17 which is radially entered in the wall of tubing 2, and engages a groove 18 cut in the hub of knob 16.

Screw 14 is in engagement with a nut 19 which can slide within tubing 2, but is prevented from turning by a pin 20 which is radially inserted in nut 19 and is guided in a slot 21, cut lengthwise, in tubing 2. (See FIG. 4)

Between nut 19 and a pin 22, radially inserted in the lower section of shaft 11, a spring 23 is arranged. It is evident that by turning knob 16 in one direction or the other and thereby moving nut 19 up or down, the compression of spring 23 can be regulated. Furthermore, it is apparent that the arrangement described allows the front tube section 2 of the frame to be pressed down against the resistance of spring 23. Thereby the assembly of spring and associated parts slides relative to shaft 11, which shaft is held vertically stationary by virtue of the contact of the wheel 5, to which shaft 11 is rigidly connected, with the ground.

Figure 4:
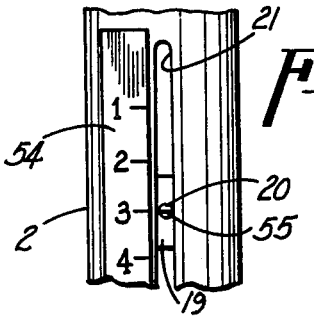
FIG. 4 is a view taken substantially along the line 4—4 of FIG. 3.
Figure 5A:
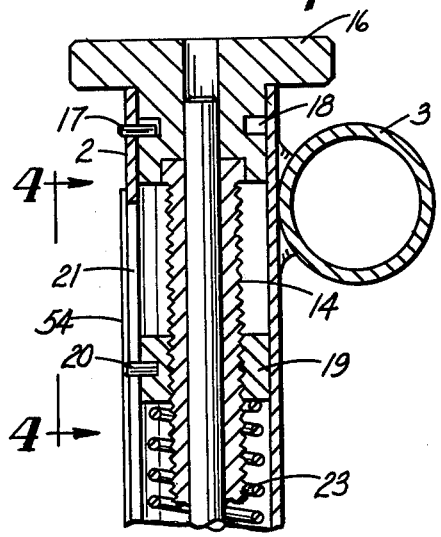
FIGS. 5*a* through 5*d* are sectional views taken along the planes referred to by lines 5*a*—5*a* through 5*d*—5*d* of FIG. 2 showing various portions of the control wheel drum utilized in the walker.
Figure 5A:
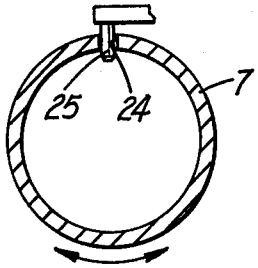
Figure 5B:
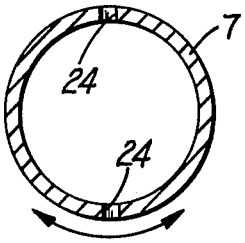
Figure 5C:
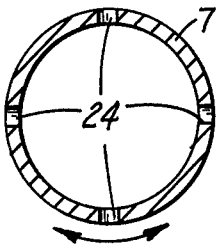
Figure 5D:
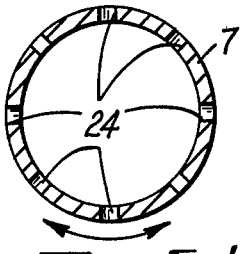

FIG. 4 illustrates in detail the construction of the pin 20 and slot 21. Adjacent to and along slot 21, a scale 54 is attached to tubing 2. Pin 20 carries a marking 55. The reading of the alignment or marking 55 with scale 54 indicates the relative position of nut 19 within tubing 2 and, with this, the pressure that spring 23 is exerting on the assembly within the tubing 2.

Figure 6:
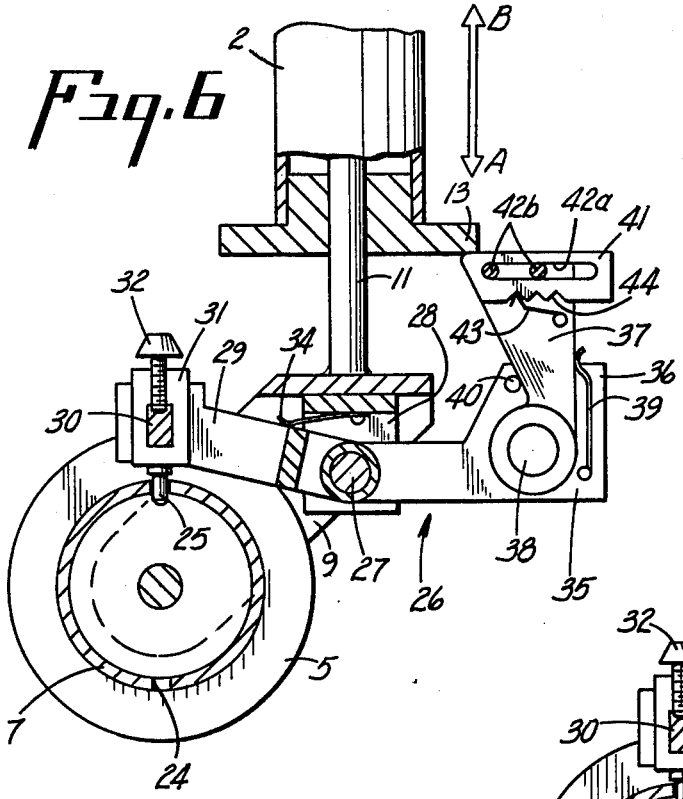
FIG. 6 is a detailed view, partially in section, of the lock and release mechanism for the control wheel.
Figure 7:
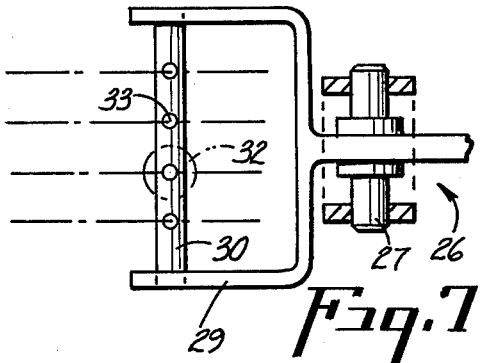
FIG. 7 is a plan view of a pin mounting yoke of the lock mechanism.

The components involved in the incremental release of the walker for a measured distance are illustrated in FIGS. 5, 6, and 7.

Holes 24 are provided in lateral sets around the periphery of the drum 7, as seen in FIGS. 5*a* – 5*d*. A pin 25 is carried on a double-arm trip lever 26 (FIG. 6). Trip lever 26 is pivotally mounted on shaft 27. Shaft 27 is supported in a U-shaped bracket 28 carried by the horizontal extension 10 of wheel side arms 9.

A U-shaped arm or extension 29 (see FIG. 7) of lever 26 extending forward over wheel 5 carries a rectangular rail 30 on which a slide 31 is shiftably mounted. The pin 25 is carried by the slide 31. Pin 25 is designed to engage any hole 24 in drum 7. Extension 29 is dimensioned to allow slide 31 and pin 25 to be aligned with the several circumferential sets of holes 24. Slide 31 is held in the selected alignment by a set screw 32 which engages a corresponding indexing hole 33 in bar 30. A spring 34 (see FIG. 6) fastened to bracket 28 and acting on an extension 29 of lever 26 urges extension 29 toward drum 7.

Any hole 24 which is engaged by pin 25 will cause the arresting of the walker's motion. Lifting pin 25 from the hole 24 in which it is engaged, will release the walker for advancement in any direction. This advancement will again be stopped when pin 25 encounters in its path another hole 24 and, preferably under spring tension engages in the hole.

In order to allow for selecting various increments of advancement upon each release by disengaging pin 25, several parallel circumferential sets of holes 24 are provided, each having a different number of holes 24. To a first set (FIG. 5*a*), just a single hole 24 is alloted. A lock pin positioned on rail 30 to engage the first set will generate the release of an incremental advancement, when released, equal to the circumference of rims 6, and then lock up again. A second set (FIG. 5*b*). having two equally spaced holes 24, will produce incremental advance equal to one half of the circumference of the caster wheel. In the same way, four holes 24 equally spaced in the set at position FIG. 5*c* or eight holes 24 equally spaced in set of FIG. 5*d* would generate incremental advancements equal to one fourth or one eighth of the circumference of rims 6, respectively. Thus, by aligning pin 25 with a given set allows predetermining the length of the walker advancement with each disengagement of pin 25 from a hole 24.

The arrangement which is most instrumental in providing snap action release of the incremental advancement, by downwardly applied force on the tubing frame, is illustrated in FIGS. 6 and 7.

A second arm or extension 35 of lever 26, opposite extension 29, carries an enlarged free end 36. A vertically aligned latch arm 37 is mounted to pivot on pin 38 carried on free end 36. A spring 39, anchored on free end 36 and engaging latch arm 37, rotates the latch arm against a stop pin 40 counterclockwise.

Arm 37 carries a slide 41. Slide 41 has a slot 42*a* engaged by pins 42*b* carried by latch 37. Slide 41 can be horizontally displaced along the slot-pin arrangement 41–42 into several adjustable positions indexed by a detent 43 carried by latch arm 37 and engaging notches 44 cut in the lower edge of slide 41. The slide 41 is aligned to be engaged by flange 13 when the latter is moved downward in direction A through the user's action on the front sector of the walker frame.

Figure 8:
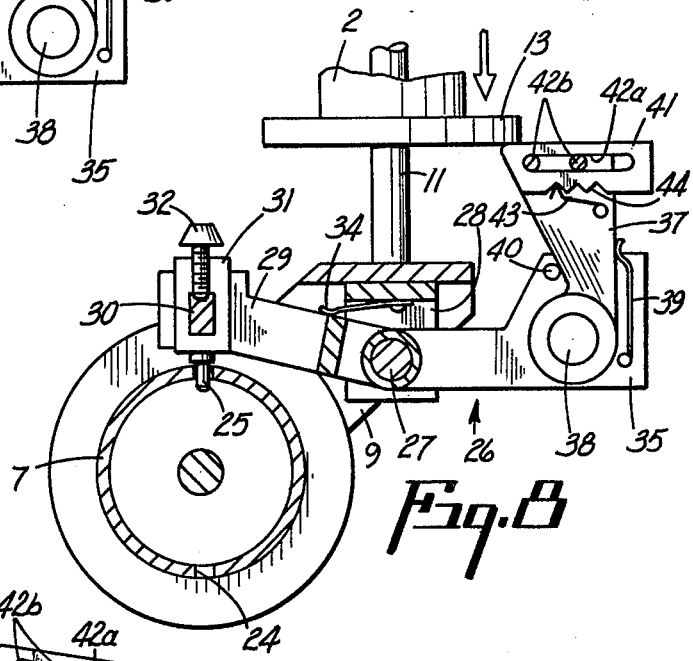
FIGS. 8 through 10 show the sequential action of the lock and release mechanism of FIG. 6.
Figure 9:
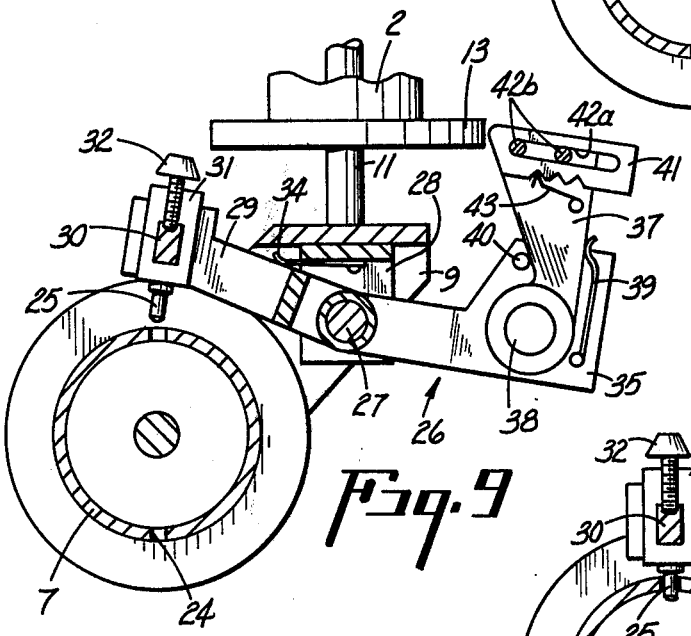
Figure 10:
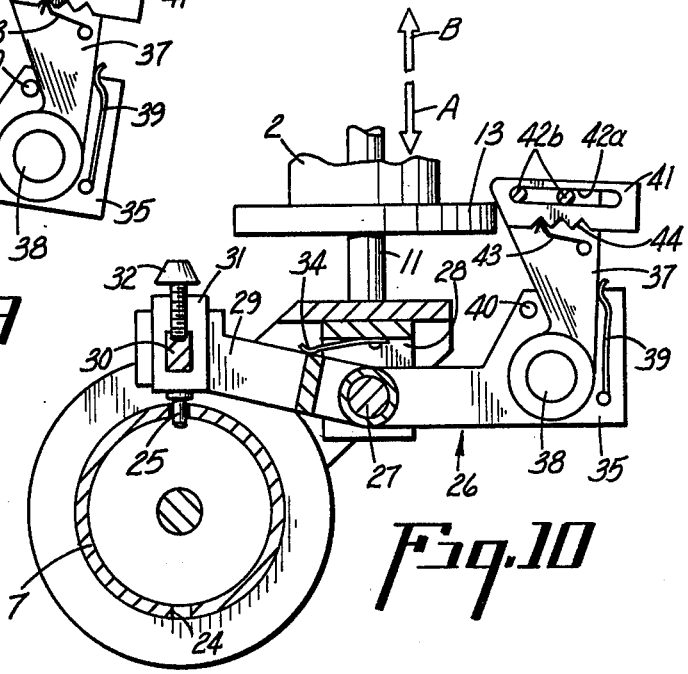
Figure 11:
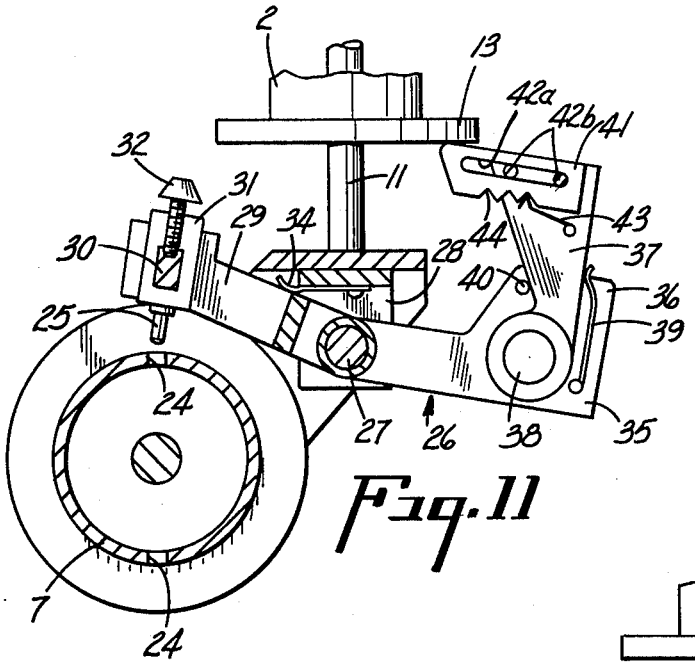
FIG. 11 illustrates an adjusted position of the FIG. 6 mechanism to cause a release hold condition by depression of the frame.

FIGS. 8 through 12 illustrate the interaction between flange 13 of the tubing assembly 2, slide 41 of the lever assembly 26, triggered through the downward engagement of the front section of the walker frame by the user. FIGS. 8 through 10 cover the interaction with slide 41 in its utmost right-hand indexed position and at the greatest distance from shaft 11, and FIG. 11 illustrates the same interaction with slide 41 in its utmost left-hand position, closest to shaft 11.

Through the user's downward engagement of the frontal frame in direction A and through the consequential engagement between flange 13 and slide 41, slide 41 because of the resulting pivoting of lever 26 is brought from the starting position FIG. 8 into the intermediary position FIG. 9.

In the position of FIG. 9, slide 41 is disengaged as a result of having followed a circular displacement path. Additionally the rounded front edge of slide 41 acting as a cam follower, and the flange 13 as a cam, assist in the final disengagement from flange 13. Simultaneously, pin 25, carried by lever 26, is lifted from hole 24 in which it was engaged. Consequently, the walker under the urging of the user immediately upon release of the pin from the hole, is allowed to advance until pin 25, sliding on drum 7, encounters and enters in the next hole 24 in its path.

Figure 10A:
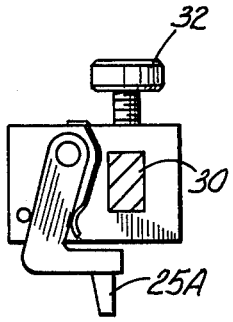
FIG. 10*a* illustrates a modified structure of a pin-lock feature.

If the frame is not under a forward bias at the time pin 25 is withdrawn, it will usually drop back into the same hole from which it was withdrawn. Therefore, the drawings, except for FIG. 10A, show a fixed pin in order to simplify the teaching of general princples, and FIG. 10A shows a preferred spring biased structure. The pin 25A is carried on a pivot support arm under forward spring bias. The pin will snap forward when withdrawn from a hole 24 and looses register. It cannot reenter the same hole, but can enter into the next hole in the series (the same hole after one revolution in plane *5a*). This feature eliminates the frustration of re-lock in the same position if the user is slow in applying advance force on the walker.

The described unlocking and locking action of pin 25, once released, and the wheel having started to rotate can in no way be influenced by any further interaction between flange 13 and slide 41. When the slide 41 has reached the position shown in FIG. 9 it is being pivoted clockwise against the action of spring 39 by the coaction of the flange 13 and the leading rounded edge of the slide 41. Thus the slide 41, after having reached and passed through position FIG. 9, remains disengaged from flange 13 during the continued downward motion of flange 13 in one direction A (to the position shown in FIG. 10). Once the slide 41 has cleared flange 13, the lever 26 is freely pivotal on pin 27, and when the drum 7 has rotated to the position at which the next hole 24 is aligned with the pin 25, the action of the spring 34 will drive the pin 25 into the aligned hole 25 preventing further rotation of the wheel 5.

During return motion of flange 13 in the opposite direction B (see FIG. 10) the flange 13 will pivot the slide 41 against the bias of spring 39, allowing the flange 39 to pass thereby and return to the position of FIG. 8. As evident from FIG. 10, slide 41, once having reached and passed through position FIG. 9, remains pressed to the outside and out of engagement with flange 13.

In summary, pressing down the front section of the frame by the user triggers with snap action the release of the walker to advance in any direction. The advancement is automatically carried out in accordance with the predetermined pin 25 — hole 24 setting and cannot be influenced or further controlled by the user's manipulations of the walker frame after the release of the wheel 5. Another incremental release can be initiated by the user only after slide 41 has been allowed to fully return to the starting position FIG. 8. Thus, the safety of the user, in carrying out incremental movements with the assist of the walker, is completely secured.

As shown in FIG. 11, a somewhat different set-up can be provided. The slide 41 is moved to the left in the utmost left-hand indexed position with the extreme right notch 44 engaging the latch 37. With this setting the slide 41 will remain in engagement with flange 13. The cam action is defeated because the swing of lever 26 is not sufficient to cause the cam end to escape the flange 13. Consequently, the walker can be advanced in any direction as long as the frame is held under load. Only upon releasing the pressure exerted on the frame and allowing the latter to return to its starting position will the walker again be arrested. Thus, the movements are no longer incrementally controlled, as is the case when slide 41 is shifted into the right-hand control position, as illustrated in FIGS. 8 to 10. The FIG. 11 set-up is designed for handicapped persons who are less afflicted with walking or balance difficulties and are therefore able to direct and control the walker's motions with more freedom.

Figure 12:
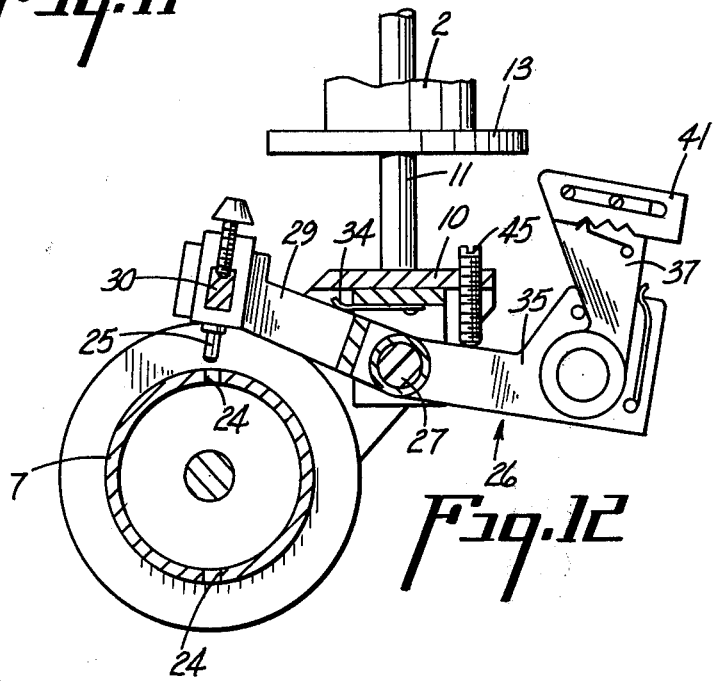
FIG. 12 is a detailed view, partially in section, of another embodiment of a release lock-out mechanism for the control wheel.
Figure 13:
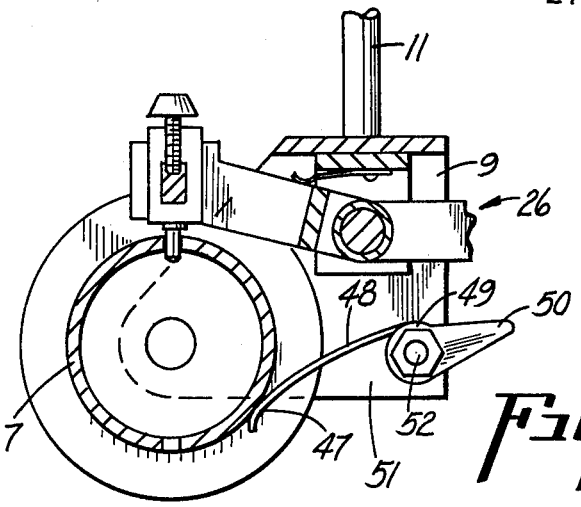
FIG. 13 is a detailed view of friction retard mechanism which may be applied to the control wheel.

Two additional arrangements designed to expand the walkers's accomplishments are illustrated in FIGS. 12 and 13.

The arrangement of FIG. 12 allows inactivating the basic incremental control, thereby converting the walker into strictly a rolling instrument design for those who are less afflicted with walking difficulties. A screw 45 fits into a threaded hole cut into the horizontal extension 10 of the widened horizontal connector 10. Turning screw 45 to penetrate extension 10, it will eventually contact extension 35 of lever 26 and tilt lever 26 into the angular position shown in FIG. 12. In this position, pin 25 is held disengaged from drum 7 and from holes 24 which drum 7 carries. With the incremental motion control disabled, the walker is now free to roll without restrictions.

The arrangement of FIG. 13 provides adjustable braking action for the walker's movements. The braking action is not affected by the various adjustments the walker may receive. One end 47 of a spring-steel band 48 is rigidly fastened to a disc 49 from which a lever 50 extends. End 47 is tightly connected to a widened section 51 of side arm 9 by means of a screw 52. The free end 47 of band 48 contacts drum 7 of the drum 7 with a given spring tension. The sliding friction between free end 47 and drum 7 when in motion generates the desired braking action. This braking action can be adjusted by loosening screw 52, turning end 47 in one direction or the other through the engagement of lever 50, thereby varying the spring tension on drum 7, and by fixing the adjustment through again tightening the screw 52.

The following functions can be carried out with the walker of the present invention, in accordance with the chosen set-up:

Set-up 1

Adjustments.

Slide 31, FIG. 6 is shifted into alignment with a given circumferential line of holes 24, to secure the chosen incremental advancement of the walker.

Knob 16, FIG. 3 is turned one way or the other to regulate the spring resistance to be overcome in pressing down the front section of the walker frame.

Slide 41, FIGS. 6 and 8 is in its utmost right-hand indexed position.

Screw 45, FIG. 12 is retracted in order not to disable the incremental control.

By adjusting the tension of steel band 48, FIG. 13, a given braking action on the walker's motions may be added.

Functions.

Pressing down the front section 2 of the frame by the user without simultaneously advancing the walker causes a momentary release of the engagement between pin 25, FIG. 5 and hole 24, FIG. 5. Consequently, the pin 25A of the preferred structure will snap forward and prevent relocking which can occur if fixed Pressing down the front section of the frame by the user and initiating advancement bias allows the walker to move in any direction until pin 25, sliding on drum 7, FIG. 6, encounters another hole 24 and enters it under action of spring 34, FIG. 6. Thus, an incremental advancement of the walker is automatically triggered and executed. The length of the increment, the pressure required to engage the frame and the braking action (if any) during the walker's advancement are determined by the adjustments cited above.

Set-up 2

Adjustments.

Slide 31, FIG. 6 is shifted into alignment with a given circumferential line of holes 24, FIG. 5 in selecting the incremental advancement of the walker.

Knob 16, FIG. 3 is turned one way or the other to regulate the spring tension required to engage the front section of the walker's frame.

Slide 41, FIGS. 6 and 8 is shifted to its utmost left-hand indexed position FIG. 11.

Screw 45 (if used) FIG. 12, remains retracted in order not to disable the incremental control. Adjusting steel band 48, FIG. 13 (if used) secures a given braking action on the walker's motions.

Functions.

As long as the front section of the frame is pressed down and held down by the user, pin 25, FIG. 5 is disengaged from hole 24, FIG. 5. Consequently, the walker can be rolled freely in any direction. Only when the user releases the pressure exerted on the walker's frame will pin 25 re-engage the nearest hole 24 and thereby again arrest the walker. The length of the increment within which the rearresting of the walker takes place, the pressure required to hold down the walker's frame in order to release the walker's motions and the potential braking action on the walker's movements are established through the adjustment cited above.

Set-up 3

Adjustments.

Screw 45, FIG. 12 is entered all the way into the horizontal extension 10, of the connector 10 thereby inactivating the lever 26, assembly which controls the incremental release of the walker's motions.

Adjusting steel band 48, FIG. 13 provides the desired braking action on the walker's motions.

With the walker's incremental control being divorced in this instance, the adjustments through slide 31, FIG. 6, knob 16, FIG. 3 and slide 41, FIGS. 6 and 8 have no bearing on the walker's performance.

Functions.

The walker can be rolled in any direction. The walker's motions are only somewhat restrained by the potential braking action generated by steel band 48, FIG. 14. The invention embodiment illustrated is usually intended for the more severely handicapped, and for use in the home. A more portable version may be incorporated as a cane or crutch adaptation, wherein one handle terminates in a three-prong caster, at least one of which is constructed as shown in the drawings. The frame is then the base portion with single handle stem.

What is claimed is:

1. A walker device, comprising, a frame having a plurality of support points, roller means for providing full mobility of the device, releasable lock means on said roller means, lock release means operatively associated with said lock means, means initiated by a user and thereafter independent of operator control for actuating said lock means and said lock release means through a cycle which includes a lock release and subsequent reengagement of the lock whereby the user is free from control judgement over the distance the walker will advance after lock release;

said roller means being a wheel with a drum carried thereby, said lock means being a series of aligned holes spaced circumferentially around said drum, and a retractable lock pin insertable in any aligned hole in said drum, said drum having a plurality of laterally spaced circumferential paths of holes therealong, each path having a different number of holes, and means to selectively and manually position said pin in alignment with one of said paths, whereby a lock cycle will release the wheel for advance a distance represented by the circumference of the wheel divided by the number of said holes in the selected path.

2. In the walker device of claim 1, said drum of said wheel and the frame having a pin and socket coupling construction which may be locked and separated with resillient cushion means biasing said coupling in a normally separated relationship.

said roller means being a wheel with a circumferential surface, said lock means having at least one rotary position of said circumferential surface wherein lock engagement is possible, a trip lever having a first position wherein said coupling is engaged to lock said roller means, and a second position wherein said coupling is disengaged to said normally separated relationship, a cam and cam follower interface between said frame and trip lever positioned to actuate said trip lever through a cycle from said first to said second position upon movement of the frame and lever against the resiliency of the cushion means to release said coupling, and to allow said coupling to be actuated by said biasing means to said first position upon further movement of said frame and lever axially, and means permitting the cam followers and cam to override without releasing the coupling means upon return movement axially of the frame and latch responsive to the cushioning means, whereby the device may be pushed along a surface by pressing downwardly and forward on said frame to release the coupling and allow rolling of said wheel only for a measured distance during disengagement of said coupling means.

3. The device of claim 2 wherein an operator selection means is provided for altering the resilient resistance of said cushion, whereby the device is tuned to the weight and strength of the intended user.

* * * * *